United States Patent [19]

McKinnon et al.

[11] Patent Number: 4,671,884

[45] Date of Patent: Jun. 9, 1987

[54] ANTISTATIC COMPOSITION

[75] Inventors: Alan J. McKinnon; Allan J. Vivian; Douglas A. Rankin, all of Christchurch, New Zealand

[73] Assignee: Wool Research Organisation, Lincoln, New Zealand

[21] Appl. No.: 908,908

[22] Filed: Sep. 18, 1986

Related U.S. Application Data

[63] Continuation of Ser. No. 718,195, Apr. 1, 1985, abandoned, which is a continuation of Ser. No. 530,397, Sep. 9, 1983, abandoned.

[30] Foreign Application Priority Data

Sep. 9, 1982 [NZ] New Zealand ..... 201857

[51] Int. Cl.[4] ..... D06M 11/00

[52] U.S. Cl. ..... 252/8.8; 252/528; 252/547; 427/393.4

[58] Field of Search ..... 252/8.8, 528, 547; 427/393.4

[56] References Cited

U.S. PATENT DOCUMENTS

| | | | |
|---|---|---|---|
| 3,660,286 | 5/1972 | Sepulveda et al. | 252/8.8 |
| 3,681,241 | 8/1972 | Rudy | 252/8.8 |
| 3,686,025 | 8/1972 | Morton et al. | 252/8.8 |
| 3,711,414 | 1/1973 | Hewitt | 252/8.8 |
| 3,892,669 | 7/1975 | Rapisarda et al. | 252/8.8 |
| 4,389,448 | 6/1983 | Green | 252/8.8 |
| 4,391,605 | 7/1983 | Bakker | 252/8.8 |

*Primary Examiner*—Paul Lieberman
*Assistant Examiner*—Willie J. Thompson
*Attorney, Agent, or Firm*—Bert J. Lewen; Henry Sternberg

[57] ABSTRACT

A textile treatment composition comprises a water insoluble quaternary ammonium salt and a non-ionic surfactant containing at least one long-chain alkyl or fatty acid substituent and a hydrophilic group. The quaternary ammonium compound preferably has three large alkyl substituents of at least carbon atoms each and the surfactant may be selected from phosphine oxides, sulphoxides, or tertiary amine oxides, especially the latter. The compositions may be diluted with water and applied to textile materials especially wool, to give antistatic properties thereto. Compositions of the invention have lower soiling propensity than hitherto available compositions and they may therefore be applied to finished carpets, either in the piece or in situ applications.

7 Claims, No Drawings

ANTISTATIC COMPOSITION

This is a continuation of co-pending application Ser. No. 718,195 filed on Apr. 1, 1985 which, in turn is a, continuation of Ser. No. 530,397 filed on Sept. 9, 1983, both now abandoned.

This invention relates to an antistatic composition for textiles and more particularly for carpets, and to methods of using same.

Static electrical charges are generated on a person's body when traversing carpeted areas, due to the contact electrification at the shoe sole-carpet interface, and the subsequent distribution of this charge over the body creates a 'body voltage'. The tendency to generate high body voltages is particularly pronounced at low relative humidities. Such static electricity not only causes objectionable shocks when the body is discharged to earth, but can cause serious problems with electronic equipment, present a hazard in the presence of flammable gases (notably in operating theatres), and cause problems during treatment such as pick-up of lint and other adventitious material when dry fabrics or garments are being handled.

Carpets, including wool carpets, may be rendered free from static electricity by incorporating therein various types of conductive fibres of filaments, used either with or without a conductive primary backing or conductive latex compound. However such an expedient is relatively expensive, and cannot be employed with already made carpets. Alternatively, chemical treatments of various kinds may be applied to the carpet pile fibre to assist in the prevention or dissipation of static charges. One such treatment involves quarternary ammonium compounds. A particular compound, trioctyl/decyl methyl ammonium chloride available commercially as Aliquat 336 (Henkel), and Adogen 464 (Sherex Chemical Co), contains three large alkyl substituents on the nitrogen and is thus water-insoluble.

British Patent publication No. 2081731 discloses a composition in which the insoluble quaternary compounds is mixed with a polyether compound. Such compositions (usually homogeneous themselves) have the property that when diluted with water to working strength for the most commonly employed application techniques they form a homogeneous solution or a dispersion of the quaternary compound which can be readily applied to textiles.

However the polyether compounds employed may give rise to soiling problems if not removed before use of the carpet, and thus the application of these compositions is effectively precluded for in situ treatments or in piece-finishing.

The invention seeks to provide a composition which gives an acceptable antistatic finish to textiles, which is economical and easy to use, and which overcomes or reduces the above disadvantages.

According to the broadest aspect of the present invention there is provided a textile treatment composition which comprises a water-insoluble quaternary ammonium salt and a non-ionic surfactant containing at least one long-chain alkyl or fatty acid substituent and a highly dipolar hydrophilic group.

Preferably, the surfactant may be selected from the classes: phosphine oxides, sulphoxides or tertiary amine oxides, especially the latter.

According to another aspect of the present invention there is provided a method of imparting antistatic properties to textile materials which includes treating the material with an aqueous solution of a composition as defined above.

The textile materials are advantageously keratinous materials, for example wool, and may be in the form of carpets, piece goods, knitwear, yarn, roving, slubbing or loose stock.

The water-insoluble quaternary ammonium salts may be those in which the nitrogen atom has three large alkyl substituents, preferably of at least eight carbon atoms each. A particularly useful product is available commercially under the name Aliquat 336 (Henkel).

It has been found that one class of surface-active compound is particularly effective in producing homogeneous compositions when mixed with water-insoluble quaternary ammonium salts and appropriate amounts of water. Further, these compositions also produce dispersions or homogeneous solutions when diluted with water to the working strength appropriate for commercial application. Particularly effective within this class of surfactants are the tertiary amine oxides; for example, lauryl dimethyl amine oxide as typified by the commercial product Ammonyx LO (Onyx Chemical Compamy). Other surfactants containing similar dipolar hydrophilic groups, such as the sulphoxide and phospine oxide surfactants, may also be used. For example a typical sulphoxide surfactant, lauryl methyl sulphoxide, behaves similarly to lauryl dimethyl amine oxide, in solubilising water-insoluble quaternary ammonium compounds in dilute aqueous solutions. In general any nonionic sufactant containing at least one long alkyl or fatty acid substituent and a hydrophilic group may be employed, and examples of such compounds other than thosealready mentioned are the sugar esters.

The weight ratio between the surfactant and the quaternary ammonium compound in the composition of the invention will depend on a number of factors, including the exact chemical types selected, expected dilution level, active percentage of pure chemical in commercial supplies, and so forth.

Amine oxide surfactants, for example, are commonly sold as aqueous solutions or pastes. For example, Ammonyx LO is supplied as a 30% active aqueous solution. Compositions ranging from a ratio by weight of Ammonyx LO (30% active by mass) to Aliquat 336 of 1.7 to less than 0.5 (i.e., a ratio of from 0.51 to less than 0.15 based on active amine oxide) form clear homogeneous mixtures upon combining and stirring the two components. When diluted with water, mixtures ranging in the above composition ratio from more than 3.2 to 1 (0.96 to 1 based on active amine oxide) will on high dilution form true homogeneous solutions at working concentrations for exhaustion processes up to at least the greatest dilution of practical interest, which is a concentration of about 50 parts per million Aliquat 336 in the solution.

The concentration of Aliquat 336 in dilute solution at which separation into two phases just commences has been approximately determined for a range of initial ratios of Ammonyx LO/Aliquat 336 concentrations. If the ratio by mass of the two materials is R, and the solubility limit of the cationic compound in % (w/w) is Q, the relationship between the two over a considerable range is approximately given by $R=2.0\ Q+0.8$.

In the case of lauryl methyl sulphoxide, rather similar behaviour occurs, but with homogeneous phases existing over more restricted composition ranges. Lauryl methyl sulphoxide is soluble in Aliquat 336 at a ratio of 1 part to 10 by weight, but at 1 part to 5 it precipitates. The solubility is enhanced, however, by adding small quantities of water, and for instance a composition of 5 parts Aliquat, 2 parts lauryl methyl sulphoxide, and 3 parts water is a clear homogeneous solution. Such a mixture when diluted to a concentration of 0.075% of Aliquat by weight gives a clear solution, part of which when analysed for Aliquat gives the correct nominal concentration. Such preparations thus appear to be genuine solutions comparable in their utility to the preparations with amine oxides. At a concentration of 0.15% in Aliquat, such a preparation gives by contrast a heterogeneous system.

As the amount of Aliquat is increased, the system Aliquat/Ammonyx LO/water separates into two phases. At very low additions of water, a single phase is again produced.

Such amine oxide compositions may be used as in the examples given below, to give antistatic treatments of wool or wool-rich carpet pile with a high degree of permanence and durability to wear and wet cleaning. The compositions may be applied, inter alia, by the following methods:

1. application by exhaustion in a batch process to yarn in a hank dyeing machine or similar vessel, or to loose wool in a loose wool (stock) dyeing machine or similar vessel;

2 application by exhaustion in a continuous process in a yarn scouring machine or similar device; and 3. application as a component of a spinning lubricant formulation In addition, two further application procedures are particularly advantageous with the present compositions. The first is to laid carpets in situ using a shampoo machine or spray. The second is to carpets in the piece during manufacture by either spray or foam application techniques. In these procedures there is a particular advantage of compositions of the invention over polyether compositions, arising from the much lower amount of solubilising surfactant employed in the former, and its greater substantivity on the fibre, which factors both reduce the soiling propensity of the compositions to an acceptable level thus allowing the use of compositions as a topical shampoo application or piece finishing treatment.

Another characteristic of the present compositions pertinent to in situ application by shampoo machine or piece treatment is that in many cases where two phases are present, especially at relative proportions not far removed from regions of single-phase formation, the system forms a pearlescent mixture that is readily dispersible to a stable emulsion suitable for practical use. This is in marked contrast to emulsions of, for example, Aliquat alone, which separate into relatively non-dispersible layers.

Compositions employing amine oxides have a further advantage in piece-finishing methods involving foam application, in that the amine oxides, as is well-known, are excellent foam-stabilising surfactants, and the diluted formulation can be readily foamed to high blow ratios, thus minimising the wet add-on required and the consequential drying problems in carpet finishing.

In exhaustion treatments carried out as disclosed in UK patent publication No. 2081731, the cationic Aliquat 336 substantially exhausts from the solution but the solubilising surfactant, whether polyether or amine oxide, remains predominantly in the solution and is discharged to waste. Thus, the superior soiling propensity of the present compositions is not fully realised in such exhaustion applications. Nonetheless, the lower soiling propensity of the present compositions, particularly amine oxide preparations, is an advantage over the polyether type formulations.

A further advantage of the present compositions is that, for example, the tertiary amine oxides are fairly effective short-term antistatic agents in their own right. The tertiary amine oxides may thus be regarded to some extent as an additive to the antistatic effect rather than merely conferring a solubilising action on the antistatic agent.

The invention will be illustrated further in the following Examples.

EXAMPLE 1

Hank-exhaustion treatment (commercial hank treatment, pilot plant carpet make-up)

Wool yarn (R600/2 tex, standard Axminster yarn) was commercially treated in a dye vat after hank dyeing, with 0.9% o.w.w. of 1:1 Aliquat 336:Ammonyx LO mixture, for 20 min. at 20° C. After drying, a sample of the yarn was tufted a small piece of carpet, of 5/32" gauge construction with 24 stitches/dm and 10 mm pile height. This was backed with a standard non-conductive carpet latex and a secondary jute back. The body voltages recorded at 21° C., 20% rh (by a method similar to AATCC Method 134-1979 were as follows:

| | Stepping Walk | Scuffing Walk |
|---|---|---|
| Rubber soles | −1000 | −1600 |
| Leather soles | +1800 | +2000 |

A comparable untreated carpet produces voltages in the range −10,000 to −15,000 volts, and a treatment giving body voltages of less that ±2500 is regarded as adequate.

EXAMPLE 2

Continuous Brattice Scour Treatment (commercial batch, commercially woven carpet).

A brattice scour bowl liquor was made up to a concentration of 0.06% (w/w) in Aliquat 336 by dissolving 2.4 kg of Aliquat 336/Ammonyx LO mixture in the bath at ambient temperature. Hanks of 80/20 wool/nylon yarn (450 grams each) were passed through this bowl, at a rate of approximately 30 hanks per minute, with a 2 min. residence time. A 5% w/w dispersion of Aliquat 336/Ammonyx LO mixture (1:1) was metered in at a rate of about 1680 ml/min, giving an add-on assuming bath equilibrium of 0.39% w/w of Aliquat 336 on the wool component of the yarn.

An Axminster carpet was then woven, predominently from the yarn treated as above, with other lots treated similarly also included in the pattern. This was a 7-shot, 7-pitch carpet of 7 mm pile height. When tested for static at 21° C., 20% rh, the following results were obtained:

| | Body Voltages, volts (3-sec. time constant) | |
|---|---|---|
| | Stepping Walk | Scuffing Walk |
| Rubber soles | +1700 | +900 |
| Leather soles | +1600 | +1300 |

Such a treatment has, then produced an acceptable level of body voltage.

EXAMPLE 3

Applications by Exhaustion on to Stock-dyed Wool

Scoured loose crossbred wool (14 kg) was dyed in the stock carrier of a GRU-15 dyeing machine, with a typical premetallised dye recipe. An Aliquat 336/Ammonyx LO mixture (equal parts by weight, 140 g in all, 0.5% Aliquat 336 oww) was dissolved in the side tank at 20° C., and the liquor transferred to the dyeing vessel containing the wool and circulated for 20 min. The liquor was then dumped, and the wool hydroextracted, dried and converted to yarn (R600/2 tex, 140 tpm, folding twist).

The exhaustion of the Aliquat 336 from the treatment liquor was 91%.

The yarn was scoured in a commercial tape scour (4 bowls, 3 at 60° C., the last at 50° C., Teric GN9 nonionic detergent in first two bowls) and then tufted into a cut-pile carpet (5/32" gauge, 7 mm height, 40 stitches/dm, backed with latex and a secondary backing of jute).

Static tests were carried out on this carpet in the same way with the following results for body voltages:

Rubber soles, stepping walk: =1000

Leather soles, stepping walk: 0

In this experiment, small yarn samples were placed uniformly within the loose wool in the stock carrier, and were subsequently analysed for Aliquat 336 by the ether extraction of the Orange II dyestuff complex.

The results showed that the treatment was satisfactorily level, the quantity of Aliquat 336 recovered from the six yarn samples averaging 0.152% (m/m) with a standard deviation of 0.024.

It is noteworthy that in this Example the quantity of Aliquat 336 remaining on the yarn after scouring is such as to yield a body voltage close to zero.

EXAMPLE 4

Application as a Component of a Woollen Processing Lubricant

Undyed loose wool (10.5 kg) was oiled during blending by hand spraying with 3 litres of a mixture prepared by diluting with water a concentrate of 315 g of Frescolene B and 105 g of 1:1 Aliquat 336/Ammonyx LO mixture. The concentrate in this case was homogeneous but the diluted material was a fairly stable dispersion. The wool was carded and spun on the woollen system to yarn as before (R600/2 tex, 140 tpm ply twist), scoured as in the stock dye application example above, and tufted to the same carpet construction. The body voltages obtained from a test at 21° C., 20% r.h., were:

Rubber soles, stepping walk: +800

Leather soles, stepping walk: +1400

A completely homogeneous lubricant formulation which yields similar results may be made by modifying the mixture somewhat. For example, a concentrate consisting of 50 g Aliquat 336, 150 g Ammonyx LO, and 250 g Frescolene B is homogeneous and when diluted to 2.5 liters for application to wool (10 kg) remained homogeneous. Such formulations have advantages in practical applications over heterogeneous mixtures.

EXAMPLE 5

Application in Foam Form to Carpet Pieces

Aliquat 336 - amine oxide preparations are suitable for application to carpet pieces by either spraying or foam application. The latter has decided advantages in terms of uniformity and control of add-on and penetration, and minimising of water to be subsequently removed in drying. A typical foam application is detailed in the following example.

A dispersion of 1:1 Aliquat:Ammonyx LO (2% w/w) was pumped to the foaming head of a carpet latex foaming unit, and foamed therein at an air delivery pressure of from 6–10 psi to produce a foam with a blow ratio of from 15 to 22. This foam was delivered to a foam trough mounted above a revolving horizontal roller. The trough was equipped with a variable aperture and doctor blade so as to enable a uniform foam layer from 6 to 20 mm thick to be carried away by the roller, and delivered down a glass scraper blade bearing against the roller just below the level of its horizontal axix. The foam layer then was allowed to flow from the lower edge of the scraper blade to a carpet passing horizontally immediately beneath it. The carpet was subsequently drawn across a vacuum slot approximiately 4 mm wide, to which suction was applied via an ordinary vacuum cleaner.

By appropriately varying the foam add-on, liquor concentration, and suction, it is possible to get satisfactorily uniform foam penetration into the carpet.

A dense carpet was treated with 20 mm height of foam at a blow ratio of 15:1, prepared from the dispersion described above, passed slowly over the vacuum slot, dried, and assessed for uniformity of foam penetration by staining the carpet in cross-section with Orange II. This revealed fairly uniform uptake of Aliquat at all levels in the pile. Different antistatic levels can be achieved by varying the concentration of the starting dispersion.

EXAMPLE 6

Application by hand-held airless spray to wool carpet

A stable turbid emulsion of 1.8% of an Aliquat 336/Ammonyx LO mixture (50/50 w/w) in water was applied by hand-held airless spray ("Fanjet" 123/15 "D" with 1.09 mm hole), using a conical device for fully enclosing the spray and preventing Aliquat particles from being breathed in by the operator. The mixture was sprayed on to 100% wool, tufted carpet, cut pile, with a surface pile weight of 650 g/m$^2$, at the rate of 50% wet add-on on the surface pile weight, spraying at the rate of 725 ml/min in 18 cm wide paths, to give a total add-on of Aliquat 336 of 0.5% on weight of pile fibre. The same carpet was also spray extraction cleaned, with water only, as an additional experiment, using a conventional spray extraction cleaning machine with a pull-back floor tool.

After drying and conditioning both treated and untreated carpets at 23° C. and 25% R.H. the following body voltages were measured (values in volts):

| | Neolite Rubber | BAM Rubber | PVC |
|---|---|---|---|
| Untreated (control) | −13,000 | −10,250 | −9,750 |
| Treated | +1,400 | 0 | +400 |
| Treated and cleaned | +1,700 | +250 | +700 |

The effect of the spray extraction cleaning is to very slightly increase the positive body voltage generated.

EXAMPLE 7

Application by hand-held spray to synthetic carpets

The general procedure of Example 6 was carried out in a range of synthetic carpets as follows:

a 100% acrylic carpet, tufted, cut pile, secondary backed a 100% polyester carpet, tufted shag pile, secondary backed a 100% polypropylene carpet, tufted, loop pile, secondary backed a 100% nylon carpet, tufted, velved, foam backed to give approximately 0.7% Aliquat 336/Ammonyx LO 50/50 mix of 0.35% o.w. fibre, Aliquat 336. The carpets were dried at ambient temperature, and conditioned to 23° C./25% R.H., then tested for antistatic effects.

| | Static Test results | | |
|---|---|---|---|
| | NEOLITE | BAM | PVC |
| U/T Polyester | +3,200 | +10,750 | 4,750 |
| Treated | +50 | 0 | 0 |
| U/T Polypropylene | + | −200 | −50 |
| Treated | −50 | 0 | −50 |
| U/T Acylic | +1,100 | +6,400 | +4,100 |
| Treated | +100 | 0 | 0 |

It can be seen that improved antistatic effects are obtained on all the carpets treated.

EXAMPLE 8

Use in Knitwear

A batch of fully fashioned knitwear wool sweater bodies was treated in a side paddle machine after drying with 0.9% oww of 1:1 Aliquat 336:Ammonyx mixture for 4 minutes at 20° C.

The goods were hydroextracted and dried in a tumble dryer. On removing from the tumbler the goods were completely free from electrostatic effect and were easy to handle during subsequent sewing, and picked up no lint fromthe sewing tables. A comparable bateh which had not received the antistatic treatment required careful brushing and picking before the garments could be packed.

EXAMPLE 9

Effect of Tertiary Amine Oxide Preparation on Soiling

The improvement found in the soiling properties following an Aliquat 336/tertiary amine oxide treatment compared to those of previously disclosed commercial formulations of the polyether type is exemplified in the following.

Woollen carpet yarn (approximately R500/2 tex, normal twist level) dyed to a yellow-beige colour was treated by exhaustion in a hank dying machine with one or other of the following treatments:

b 1. with 0.6% oww of Aliquat 336 contained in an Aliquat 336/Ammonyx LO concentrate (1 part to 3.3 parts by weight, of 1:1 on an active matter basis);

2 with 0.6% available Aliquat 336 from a polyether composition.

These treated yarns were converted into carpet of construction similar to those used previously.

These carpets were then laid in a floor trial in a busy commercial arcade, together with an untreated woollen velour carpet of comparable colour and structure. Tristimulus values were measured on these carpets at intervals and were converted to colour difference (E) values using the CIELAB formula.

| | E values at various tread counts | | | |
|---|---|---|---|---|
| | 3000 treads | 12500 | 24300 | 44000 |
| std woollen velour | 8.2 | 11.2 | 14.1 | 16.4 |
| amine oxide recipe | 4.8 | 8.6 | 10.9 | 12.9 |

-continued

| | E values at various tread counts | | | |
|---|---|---|---|---|
| | 3000 treads | 12500 | 24300 | 44000 |
| polyether recipe | 11.0 | 14.3 | 17.7 | 19.9 |

This experiment, which lists the average faults for duplicate samples in the trial, indicates that the amine oxide type of formulation has a significant benefit in reducing subsequent soiling compared to the polyether type of formulation.

Although all the examples of soluble formulations, stable dispersions, and application procedures given above are expressed in terms of specific products, comparable results will be achieved with other formulations within the scope of the invention which involve the solubilisation of any quaternary ammonium compound normally having very restricted water solubility, irrespective of the nature of the substituents on the nitrogen or the incorporation of the nitrogen into ring systems. Exemplary amine oxide-type surfactants include, in addition to the cited lauryl dimethyl amine oxide, related compounds such as stearyl dimethyl amine oxide, compounds in which the nitrogen of the amine oxide is in a heterocycle, as in N-dodecylmorpholine oxide, and in imidazoline oxides, compounds which are diamine oxides, such as N-dodecyl-N, N', N'-trimethyl-1. 3-propylene diamine-N, N' dioxide, and other substituted propylene diamine derivatives such as products of the Ethoduomeen T/13 N, N' dioxide commercial class. All comments made above in reference to the uncharged form of tertiary amine oxides as found in basic or neutral solution apply also to the hydroxylammonium cation forms of these compounds formed in acid solution.

Sulphoxide surfactants behave similarly to amine oxide surfactants in forming homogeneous solutions of water-insoluble quaternary ammonium compounds, and all the application procedures and uses of the amine oxide formulations apply to suitable sulphoxide surfactant preparations also, as well as phosphine oxide surfactants and other nonionic surfactants as previously described.

We claim:

1. A textile treatment composition which comprises a water-insoluble quaternary ammonium salt having its nitrogen atom substituted with three alkyl substituents of at least 8 carbon atoms each and a non-ionic surfactant having at least one long chain alkyl of fatty acid substituent and a tertiary amine oxide group, the weight ratio of said surfactant to quaternary ammonium salt being about 0.51:1 to 0.15:1 of active ingredients.

2. A composition according to claim 1 in which the surfactant is lauryl dimethyl amine oxide, stearyl-dimethyl amine oxide, N-dodecylmorpholine oxide, N-dodecyl-N, N', N'-trimethyl-1, 3- propylene diamine-N, N' dioxide or other substituted propylene diamine derivative.

3. A method of treating textile materials to render them anti-static which comprises applying thereto a composition as claimed in claim 1 diluted with water.

4. A method according to claim 3 in which the textile material is composed of keratinous fibres.

5. A method according to either of claims 3 or 4 in which the textile material is in the form of yarn, roving, slubbing or loose stock and in which the composition is applied by exhaustion.

6. A method according to either of claims 3 or 4 in which the textile material is in the form of piece goods or carpets and the composition is applied by foam or spray application techniques.

7. A method according to either of claims 3 or 4 in which the textile material is a carpet and the composition is applied in situ using a shampoo machine, or a spray application technique.

* * * * *